US006783014B2

(12) United States Patent
Luker

(10) Patent No.: US 6,783,014 B2
(45) Date of Patent: Aug. 31, 2004

(54) DOUBLE SHELL CLOSURE WITH SUPPORT RIBS

(75) Inventor: C. Edward Luker, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/876,336

(22) Filed: Jun. 7, 2001

(65) Prior Publication Data

US 2002/0185464 A1 Dec. 12, 2002

(51) Int. Cl.[7] ..... B65D 41/04

(52) U.S. Cl. ..... 215/334; 215/329; 215/303; 215/305

(58) Field of Search ..... 215/334, 329, 215/303, 305, 216

(56) References Cited

U.S. PATENT DOCUMENTS

| | | | | | |
|---|---|---|---|---|---|
| D24,862 | S | * | 11/1895 | Abbott | D9/453 |
| D202,827 | S | * | 11/1965 | Elkner | D9/453 |
| 3,315,830 | A | * | 4/1967 | Flynn | 215/317 X |
| 3,854,622 | A | | 12/1974 | McKirnan | |
| 3,869,057 | A | * | 3/1975 | Miller | 215/339 |
| 3,944,101 | A | * | 3/1976 | Landen | 215/216 |
| 3,958,708 | A | | 5/1976 | Le Brun, Jr. | |
| D244,356 | S | * | 5/1977 | Pardo | D9/453 |
| 4,103,798 | A | * | 8/1978 | Moeller | 215/329 X |
| 4,117,945 | A | | 10/1978 | Mumford | |
| 4,138,028 | A | | 2/1979 | Price et al. | |
| 4,273,247 | A | * | 6/1981 | Earls | 215/228 |
| 4,535,906 | A | * | 8/1985 | Rowekamp | 215/329 |
| 5,238,130 | A | | 8/1993 | Marques et al. | |
| 5,279,434 | A | * | 1/1994 | Aguirrezabal | 215/331 |
| 5,671,853 | A | * | 9/1997 | Herr | 215/216 |
| 5,850,951 | A | | 12/1998 | Hayes | |
| 5,853,097 | A | | 12/1998 | Ekkert | |
| D405,695 | S | * | 2/1999 | Zelmo | D9/453 |
| 5,915,576 | A | | 6/1999 | Robinson | |
| 5,950,851 | A | * | 9/1999 | Clodfelter et al. | 215/334 |
| 6,173,853 | B1 | | 1/2001 | Luch | |

FOREIGN PATENT DOCUMENTS

| | | | | |
|---|---|---|---|---|
| FR | 197809 | * | 9/1978 | 215/334 |

* cited by examiner

*Primary Examiner*—Tri M. Mai
(74) *Attorney, Agent, or Firm*—John F. Salazar; James E. Cole; Middleton Reutlinger

(57) ABSTRACT

A bottle closure having an outer shell with a frusto-conical configuration and a rib-supported threaded inner shell is described. The frusto-conical configuration of the outer shell allows the user to easily pickup the package and grip the closure and remove it from a bottle. The inner shell is threaded to allow the closure to engagingly mate with threads on a bottle or similar container. The inner shell is supported by ribs which face toward the outer shell. The ribs provide that the inner shell can be unscrewed from a threaded core of a manufacturing mold during production without causing noticeable distortion in the closure.

10 Claims, 5 Drawing Sheets

DOUBLE SHELL CLOSURE WITH SUPPORT RIBS

BACKGROUND

The present invention relates to a bottle closure having a frusto-conical outer shell and a rib-supported threaded inner shell.

Consumer beverages, such as milk and juices, are commonly packaged in bottles having wide necks. The wide-necked bottles are designed to allow the user to easily dispense a portion of the beverage from the bottle. In recent years, closures having an enlarged top and an inwardly projecting skirt have been used with the wide-necked bottles. The enlarged-top closures allow the consumer to easily pick up the package and open the containers. Further, the enlarged-top closures allow products to be more easily stacked for packing and shipping.

Most enlarged-top closures are injection molded from thermoplastic materials. During the closure manufacturing process, melted material is fed into a multi-part mold where the material is allowed to cool in the shape of the mold. Once the material has cooled, the mold is opened and the closure is released from the mold. If the material is not completely cooled before the mold begins to release the closure, distortions or flaws may form in the closure. Generally, if the molding unit releases the closure by parting, there are few noticeable distortions in the closure. However, if the molding unit must be unscrewed from the closure, such as when the core for producing the threads in the closure is removed, the torque generated by the unscrewing motion can cause any pliable material to twist or turn slightly leaving flaws in the finished closure. On a reverse taper closure, and particularly on a closure having a frusto-conical outer shell with a detailed outer surface, the conventional approach to attempt to overcome the twisting has been to develop means to hold the outer shell as the threaded core is removed. This has not alleviated the problem, however.

Alternatively, the closure may have stripped type threads. However, during production the stripped type threads are forced off the threaded inner core by applying a force to the outer shell of the closure. This force is transferred through the connecting top causing the top to distort or dish. To avoid distortion of the top, the threads can be stripped by applying pressure to the bottom edge of the inner shell. But the stripping element to accomplish this need to fit between the threaded core and the inner shell profile core, generally meaning that the stripping element is relatively thin and fragile. The inner core may also be forced off by applying a force though the center of the inner core. However, this tends to cause distortion or doming of the top and also restricts cooling of the threaded core.

Thus, it would be beneficial to have a double-shelled bottle closure having a frusto-conical outer shell and a threaded inner shell that would not be subject to noticeable distortion as the closure is produced.

SUMMARY

The present invention relates to a bottle closure having an outer shell with a frusto-conical configuration and a rib-supported threaded inner shell. The frusto-conical configuration of the outer shell allows the user to easily grip the closure and remove it from a bottle. The inner shell is threaded to engagingly mate with threads of a complementary bottle or similar container. The inner shell is supported by ribs which face toward the outer shell. The ribs provide that the inner shell can be unscrewed from a threaded core of a manufacturing mold during production without causing noticeable distortion in the closure top. Adding support structure, the ribs, to the closure immediately adjacent to the point of resistance (the threads) allows for a shorter cure time and, therefore, a faster production cycle and higher productivity.

DETAILED DESCRIPTION

Figure 1:
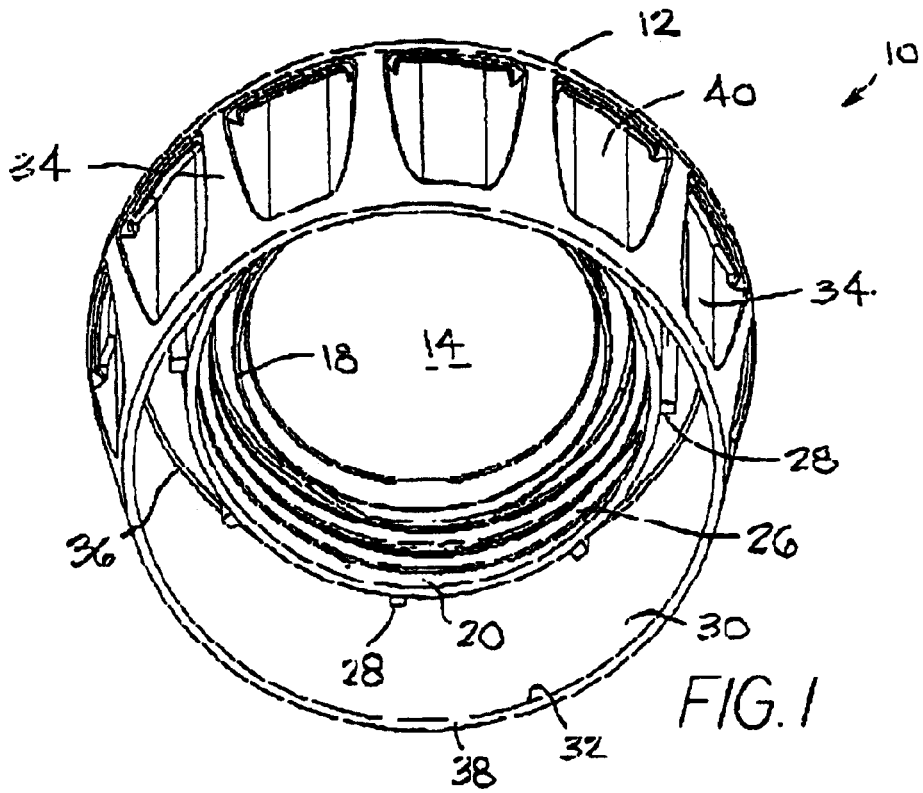
FIG. 1 is a bottom perspective view of an embodiment of a double-shelled bottle closure having a frusto-conical outer shell and a rib-supported threaded inner shell made in accordance with the present invention.
Figure 2:
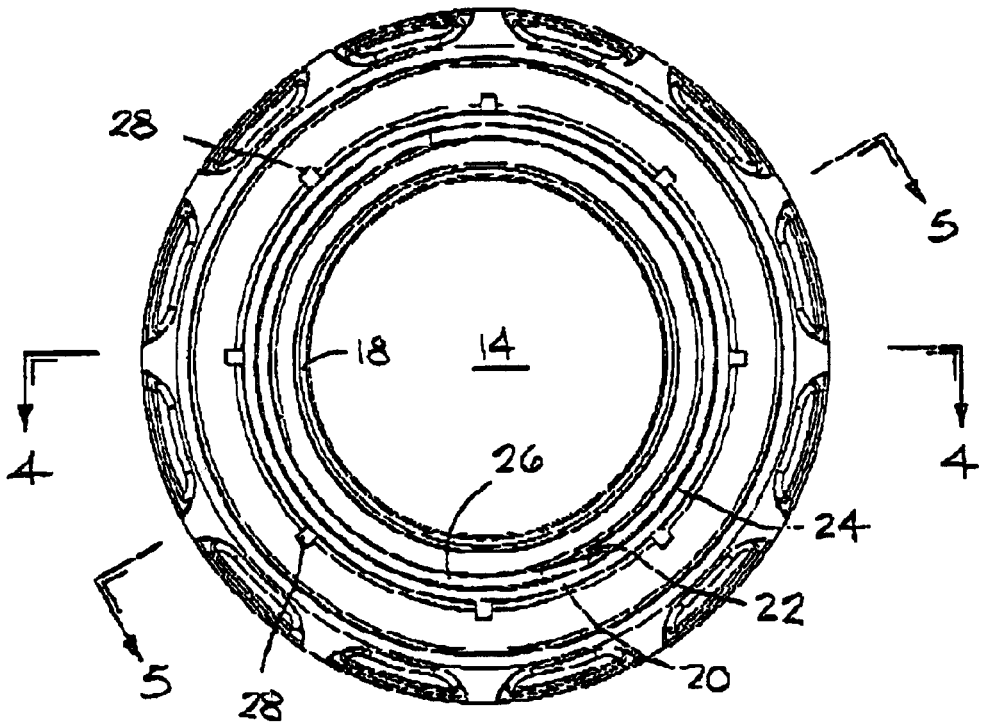
FIG. 2 is a bottom view of the closure of FIG. 1.
Figure 3:
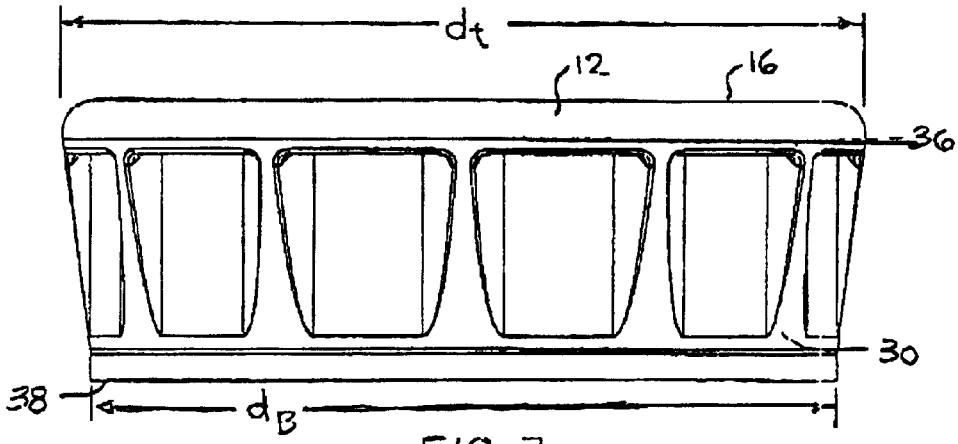
FIG. 3 is a side view of the closure of FIG. 1.
Figure 5:
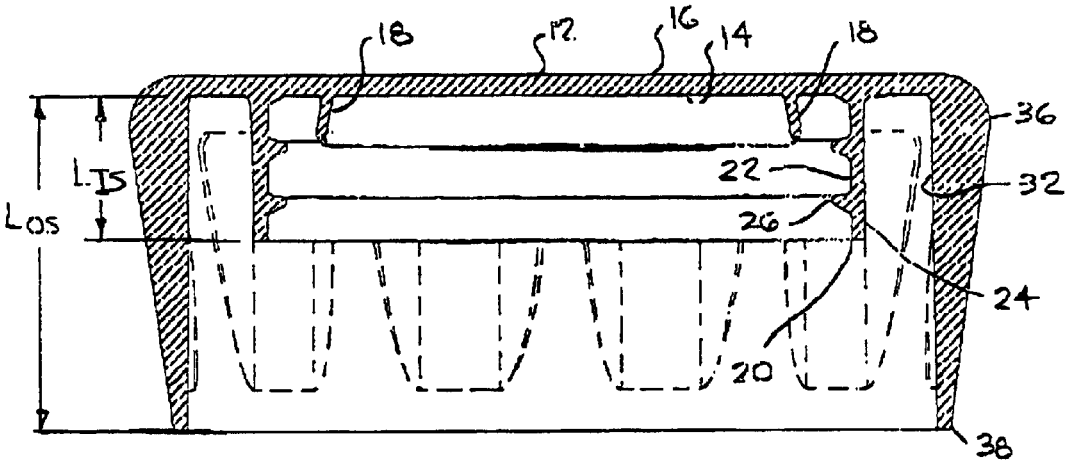
FIG. 5 is a cross-sectional view of the closure of FIG. 2 taken along line 5—5.
Figure 4:
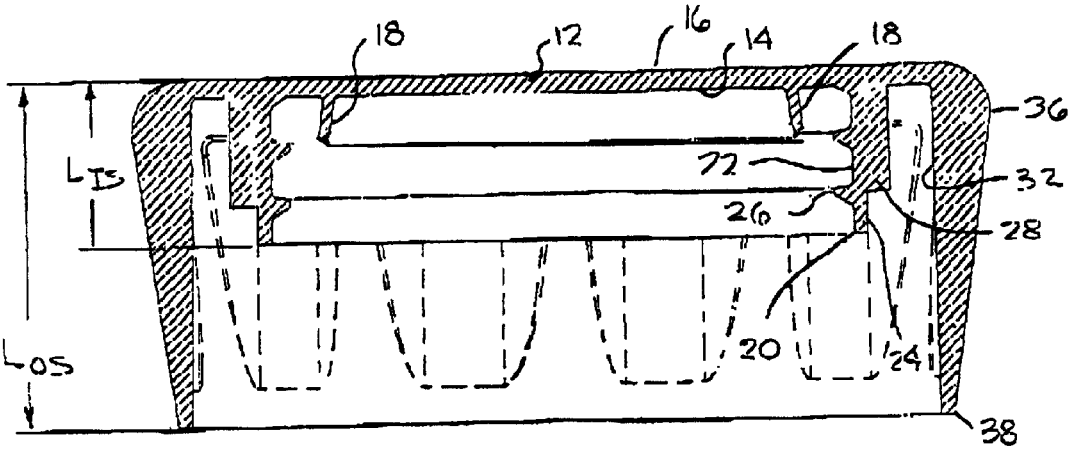
FIG. 4 is a cross-sectional view of the closure of FIG. 2 taken along line 4—4.

The present invention relates to container closure having a frusto-conical outer shell and a rib-supported inner shell. The closure depicted in the various Figures is selected solely for the purpose of illustrating the invention. Other and different closure may utilize the inventive features described herein as well.

Reference is first made to FIGS. 1–5 in which a closure constructed in accordance with the present invention is generally noted by the character numeral 10. The closure 10 has a top 12, an inner skirt or shell 20, and an outer skirt or shell 30. The top 12 has an interior surface 14 and an exterior surface 16. When in use on a bottle, the interior surface 14 abuts the bottle neck and the exterior surface 16 faces the user. Optionally, an annular flange 18 may depend from the interior surface 14 of the top 12. The flange 18 is essentially centered on the top 12 and is proportioned to fit within the bottle neck when the closure is being used and prevents liquids from leaking from the bottle.

The inner and outer skirts 20, 30 are concentric rings which depend from and are essentially centered on the interior surface 14 of the top 12. The diameter of the outer skirt 30 is greater than the diameter of the inner skirt 20, and if the flange 18 is present, the diameter of the inner skirt 20 is greater than the diameter of the flange 18.

The inner skirt 20 has an inward facing surface 22 and an outward facing surface 24. Similarly, the outer skirt 30 has an inner face 32 and an outer face 34. The inner skirt inward facing surface 22 includes one or more threads 26 which are configured to engage complementary bottle neck threads. The inner skirt outward facing surface 24 faces toward the inner face 32 of the outer skirt 30. The outer skirt outer face 34 has a top edge 36 and a bottom edge 38. Measured across the outer face, the diameter $d_T$ of the top edge 32 is greater than the diameter $d_B$ of the bottom edge 34 causing the outer skirt 30 to have a frusto-conical configuration on the exterior surface. Optionally, the outer skirt 30 may include finger grips 40 or depressions along the outer face 34. The finger grips 40 allow the user to more easily grasp and rotate the closure 10, which can be useful when manipulating a large diameter closure, but the finger grips 40 are not required for the closure to function as intended.

The closure 10 further includes one or more ribs 28 which depend from the top 12 and are attached to the outward surface 24 of the inner skirt 20. The ribs 28 may extend the entire length "$L_{IS}$" of the inner skirt 20 or they 28 may be shorter than the inner skirt 20, such as shown in FIGS. 1–5. The number of ribs 28 and location about the inner skirt may vary as necessary for the particular application. In the embodiment shown, the ribs 28 have an essentially square cross-section, but any design which allows the rib 28 to be firmly attached to the inner skirt 20 may be used. For example, as shown in FIGS. 9A–F, the cross-sectional configuration of the ribs 28 may be square (A), semi-circular (B), rectangular (C, D), wedged (E), semi-ovoid (F), or any other configuration which will support the inner skirt 20. More than one cross-sectional configuration may be used on a single closure 10 if so desired by the user.

The closure 10 is preferably manufactured from a semi-rigid thermoplastic material and can be produced using an injection molding process, as is known in the art. Typically during the closure manufacturing process, melted material is fed into a multi-part mold where the material is allowed to cool in the shape of the mold. Once the material has cooled, the mold is opened and the closure is released from the mold. For a double-shelled closure having a frusto-conical outer shell and a threaded inner shell, the multi-part mold includes a first unit with a cavity that forms the exterior portion of the top, a second unit with a cavity that forms the skirt of the outer shell and the outward face of the inner shell, and a threaded core which forms the inner threaded face of the inner shell. It is common practice to feed the melted material into the mold through the first unit and to force the material into cavities in the second unit and around the threaded core. After a closure is formed in the mold, the second unit pulls away from the first unit and the core unscrews from the closure. The closure then drops out of the mold.

Because a relatively large quantity of material is used to make enlarged-top closures, the material does not cool completely before the mold begins to release the closure. Thus, portions of the closure remain soft and pliable even as the mold releases the finished closure. If the molding unit releases the closure by parting, such as when the second unit separates from the first unit, there is essentially no noticeable distortion of the closure caused by the soft material. However, when the core is unscrewed from the closure, the torque generated by the unscrewing motion can cause the soft material to twist or turn slightly leaving flaws in the finished closure. By adding the ribs 28 immediately adjacent to the resistance (the threads 26), sufficient support is added to the inner skirt 20 that the threaded core can be removed from the closure 10 without allowing the inner skirt 20 to twist. The probability of manufacturing noticeably flawed closures is thereby reduced without the need for a longer processing cycle (adding a longer curing or cooling period so the closure can completely set before being unscrewed from the core).

Figure 6:
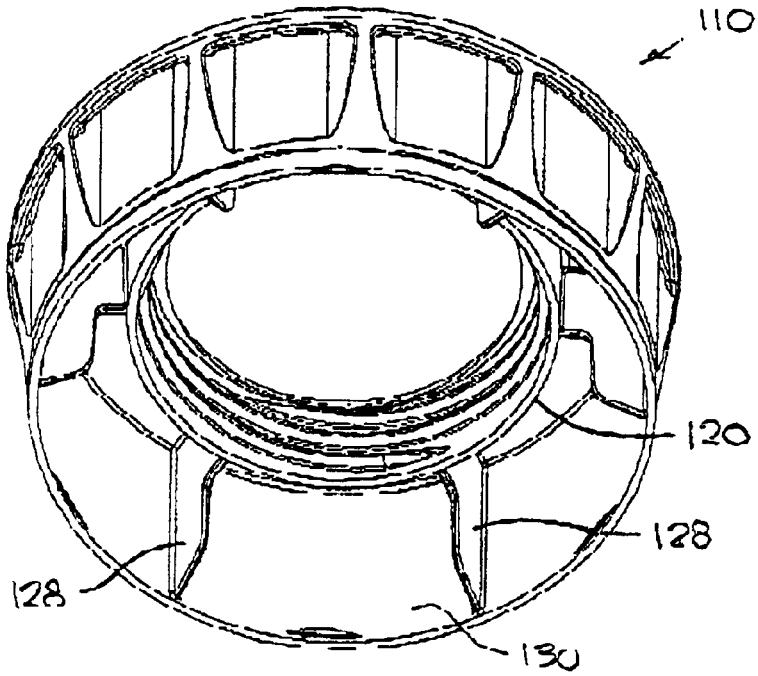
FIG. 6 is a perspective view of a first alternative embodiment of a closure having a frusto-conical outer shell and a rib-supported threaded inner shell made in accordance with the present invention.
Figure 7:
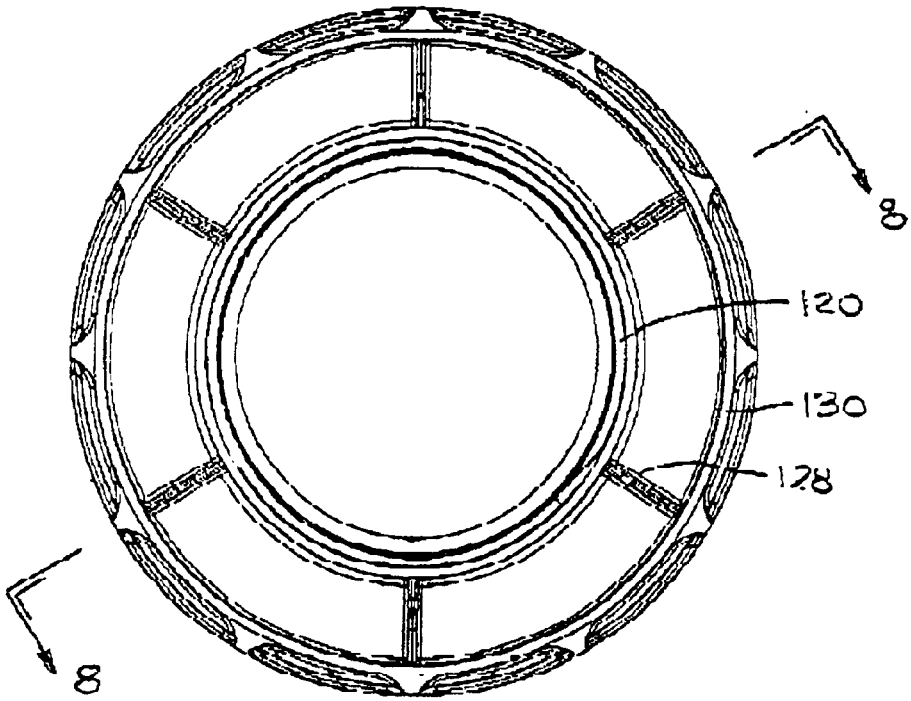
FIG. 7 is a bottom view of the closure of FIG. 6.
Figure 8:
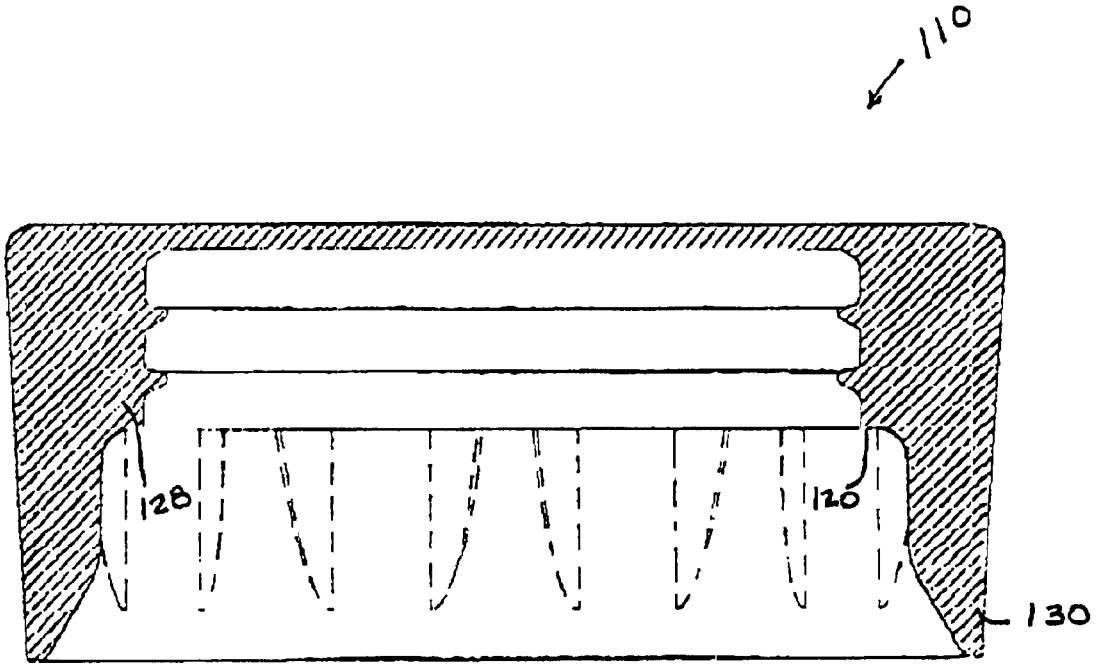
FIG. 8 is a cross-sectional view of the closure of FIG. 7 taken along line 8—8.
Figure 9A:
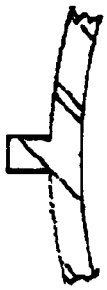
FIGS. 9A–F are cross-sectional views of alternative ribs of the closure of FIG. 1.
Figure 9B:
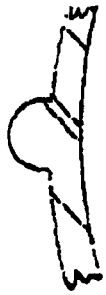
Figure 9C:
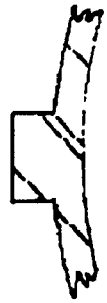
Figure 9D:
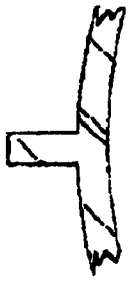
Figure 9E:
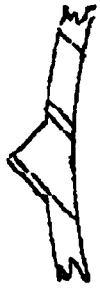
Figure 9F:
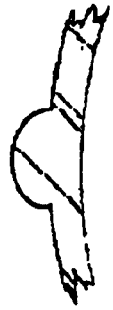

A first alternative embodiment 110 is shown in FIGS. 6–8. The closure 110 is essentially identical to the closure 10 of FIGS. 1–5 except that the ribs 128 extend from the inner skirt 120 to the outer skirt 130. A segment of the ribs 128 may extend the entire length of the inner skirt 120, such as shown in FIGS. 6–8, or they 128 may be shorter than the inner skirt 120; a segment of the ribs 128 may extend the entire length of the outer skirt 130, such as shown in FIGS. 6–8, or they 128 may be shorter than the outer skirt 130. The number of ribs 128 and location about the inner skirt may vary as necessary for the particular application. Similar to the closure 10 of FIGS. 1–5, the ribs 128 support the inner skirt 120 so that noticeable twisting flaws are not formed in the closure 110 during production.

From a reading of the above, one with ordinary skill in the art should be able to devise variations to the inventive features. For example, the ribs may have different shapes or configurations, and the closure detail, such as the finger grips on the outer shell, may vary in design. These and other variations are believed to fall within the spirit and scope of the attached claims.

What is claimed is:

1. A container closure comprising:

a. a top, having an interior surface and an exterior surface;

b. an annular outermost skirt, depending from and being centered on the interior surface of said top, said outermost skin having a first face which faces inward toward the center of said outermost skirt, a second face which faces outward from said outermost skirt, a top edge which abuts said top, and a bottom edge, and said outermost skirt having a first diameter at the top edge of the outward face and a second diameter at the bottom edge of the outward face wherein said top diameter is greater than said bottom diameter causing said outermost skirt to have a frusto-conical configuration on the exterior surface;

c. an annular innermost skirt, depending from and being centered on the interior surface of said top, said innermost skirt having a first surface which faces inward toward the center of the skirt and a second surface which faces outward toward said outermost skirt;

d. at least one thread attached to the inward facing surface of said innermost skirt; and e. at least one rib, depending from said top and extending radially along said top to said outermost skirt, said rib also being attached to the outward facing surface of said innermost skirt and said inward face of said outermost skirt;

f. said at least one rib having a first axial dimension at said innermost skirt and a second axial dimension at said outer skirt, said first axial dimension being less than said second axial dimension.

2. The closure of claim 1 wherein said innermost skirt defines a length and at least part of said rib is the same length as said innermost skirt.

3. The closure of claim 1 wherein said outermost skirt defines a length and at least part of said rib is the same length as said outer skirt.

4. The closure of claim 1 wherein said outer skirt defines a length and at least part of said rib is shorter than the length of said outermost skirt.

5. The closure of claim 1 wherein said innermost skirt has a diameter that is less than the bottom diameter of said outermost skirt and said closure further includes an annular flange depending from the interior surface of said top and being centered on the interior surface of said top, said flange having a diameter that is smaller than the diameter of said innermost skirt.

6. A container closure, comprising:

a top wall and an outer skirt having a first diameter depending from said top wall;

an inner skirt having a second diameter smaller than said first diameter depending from said top wall;

a plurality of ribs depending from said top wall along an inner face of said outermost skirt and extending to an outer face of said innermost skirt;

said outer skirt being tapered and being frusto-conical in shape;

each of said plurality of ribs being opposite an outer skirt rib positioned on said outer face of said outer skirt;

each of said plurality of ribs being substantially L-shaped.

7. The container closure of claim 6, each of said plurality of ribs having a first edge having a length equal to said outermost skin.

8. The container closure of claim 6, each of said plurality of ribs having a second edge having a length equal to said innermost skirt.

9. The container closure of claim 6, said rib having a tapered lower edge.

10. The container closure of claim 6, further comprising an annular flange depending from and centered on an interior surface of said top wall, said annular flange having a diameter less than said innermost skirt.

* * * * *